US005954272A

United States Patent [19]

Liao

[11] Patent Number: 5,954,272

[45] Date of Patent: Sep. 21, 1999

[54] DETERGENT/WATER MIXING SYSTEM FOR A WATER SPRAY GUN

[76] Inventor: Yu Chung Liao, P.O. Box 63-150, Taichung city, Taiwan

[21] Appl. No.: 09/066,640

[22] Filed: Apr. 24, 1998

[51] Int. Cl.[6] ..... B05B 7/28; B05B 1/30

[52] U.S. Cl. ..... 239/317; 239/581.1

[58] Field of Search ..... 239/317, 581.1

[56] References Cited

U.S. PATENT DOCUMENTS 3,381,899 5/1968 Forsman ..... 239/317

4,785,850 11/1988 Sanchez ..... 239/317 X

FOREIGN PATENT DOCUMENTS 3230783 2/1984 Germany ..... 239/317

*Primary Examiner*—Lesley D. Morris

[57] ABSTRACT

A detergent/water mixing system for a water spray gun includes a gun body having a water inlet, a water outlet, a cylindrical transverse through hole between the water inlet and the water outlet, and a bottom axle hole perpendicularly extended from the transverse through hole, a detergent container detachably attached to the gun body at the bottom side, a nozzle jet mounted in the axle hole on the gun body and controlled to eject water into the detergent container and to guide detergent solution from the detergent container into the water outlet of the gun body, and a control valve turned by hand through a handle attached thereto in the transverse through hole on the gun body to control the flowing direction of water.

4 Claims, 3 Drawing Sheets

DETERGENT/WATER MIXING SYSTEM FOR A WATER SPRAY GUN

BACKGROUND OF THE INVENTION

The present invention relates to a water spray gun, and more specifically to a detergent/water mixing system for a water spray gun.

FIG. 1 shows a structure of water spray gun according to U.S. Pat. No. 4,785,850. According to this design, a control valve 1 is rotated to close/open the passage between a water inlet 2 and a water outlet 3, and a detergent container means 4 is attached to the casing of the water spray gun at the bottom side. The container means 4 has two through holes 4A;4B respectively disposed in communication with the water inlet 2 and the water outlet 3. When water passes from the water inlet 2 through a narrow water hole 1A on the control valve 1 to the water outlet 3, a part of water flows through one through hole 4A into the container means 4 and then flows out of the container means 4 through the other through hole 4B to carry detergent out of the container means 4 to the water outlet 3. This design has drawbacks. Because the diameter of the water hole 1A on the control valve 1 is much smaller than that of the water inlet 2, the flowing speed of water is accelerated when passing through the water hole 1A, and less amount of water is capable of flowing through the through hole 4A into the container means 4. Further, the rapid flow of water which passes through the water hole 1A of the control valve 1 into the water outlet 3 produces an upward suction force, causing high concentration detergent solution to be rapidly carried out of the container means 4 into the water outlet 3, i.e., detergent solution is not well mixed with water in the container means 4 before it is carried out of the container means 4 into the water outlet 3.

SUMMARY OF THE INVENTION

The present invention has been accomplished to provide a detergent/water mixing system for a water spray gun which eliminates the aforesaid problem. It is the main object of the present invention to provide a detergent/water mixing system for a water spray gun which enables detergent to be well mixed with water before it is carried out of the water spray gun. It is another object of the present invention to provide a detergent/water mixing system for a water spray gun which can be conveniently operated to control the flowing direction of water. According to one embodiment of the present invention, the detergent/water mixing system comprises a gun body, the gun body comprising a water inlet, a water outlet, a transversely horizontally extended cylindrical through hole communicating between the water inlet and the water outlet, a cylindrical coupling portion raised from a bottom side wall thereof, and an axle hole perpendicularly extended from the cylindrical through hole through the center of the cylindrical coupling portion; a cylindrical control valve mounted in the transversely horizontally extended cylindrical through hole, the cylindrical control valve comprising a first water chamber, a second water chamber, a narrow gap communicating between the first water chamber and the second water chamber, a first stop block and a second stop block separated by the first and second water chambers and the narrow gap, a guide hole perpendicularly extended from the connecting area between the first water chamber and the narrow gap through the second stop block to the outside of the control valve, a guide wall connected between the first stop block and the second stop block adjacent to the guide hole of the control valve, and a guide groove provided at the second stop block on the outside in communication with the second water chamber; a handle connected to two opposite ends of the cylindrical control valve outside the gun body for turning by hand to rotate the cylindrical control valve in the transversely horizontally extended cylindrical through hole of the gun body; a detergent container holding a detergent and detachably fastened to the coupling portion of the gun body by a screw joint; and a jet ejector mounted in the axle hole on the gun body and suspended in the detergent container, the jet ejector comprising a nozzle jet for guiding water from the guide hole on the control valve into the detergent container, and a guide hole for guiding detergent solution from the detergent container to the second water chamber of the control valve through the guide groove on the control valve. The control valve is turned in the transversely horizontally extended cylindrical through hole on the gun body by hand through the handle between a front side position where the first water chamber and the second water chamber of the control valve are respectively set into communication with the water inlet and the water outlet, and the guide hole and guide grooves of the control valve are set into communication with the nozzle jet and guide hole of the jet ejector, a middle position where the nozzle jet and guide hole of the jet ejector are stopped by the second stop block of the control valve and water is allowed to pass from the water inlet through the first water chamber, the narrow gap, and the second water chamber into the water outlet, and a rear side position where the water inlet is stopped by the first stop block of the control valve and no water is allowed to pass from the water inlet to the water outlet through the control valve.

DETAILED DESCRIPTION OF THE PREFERRED EMBODIMENT

Figure 1:
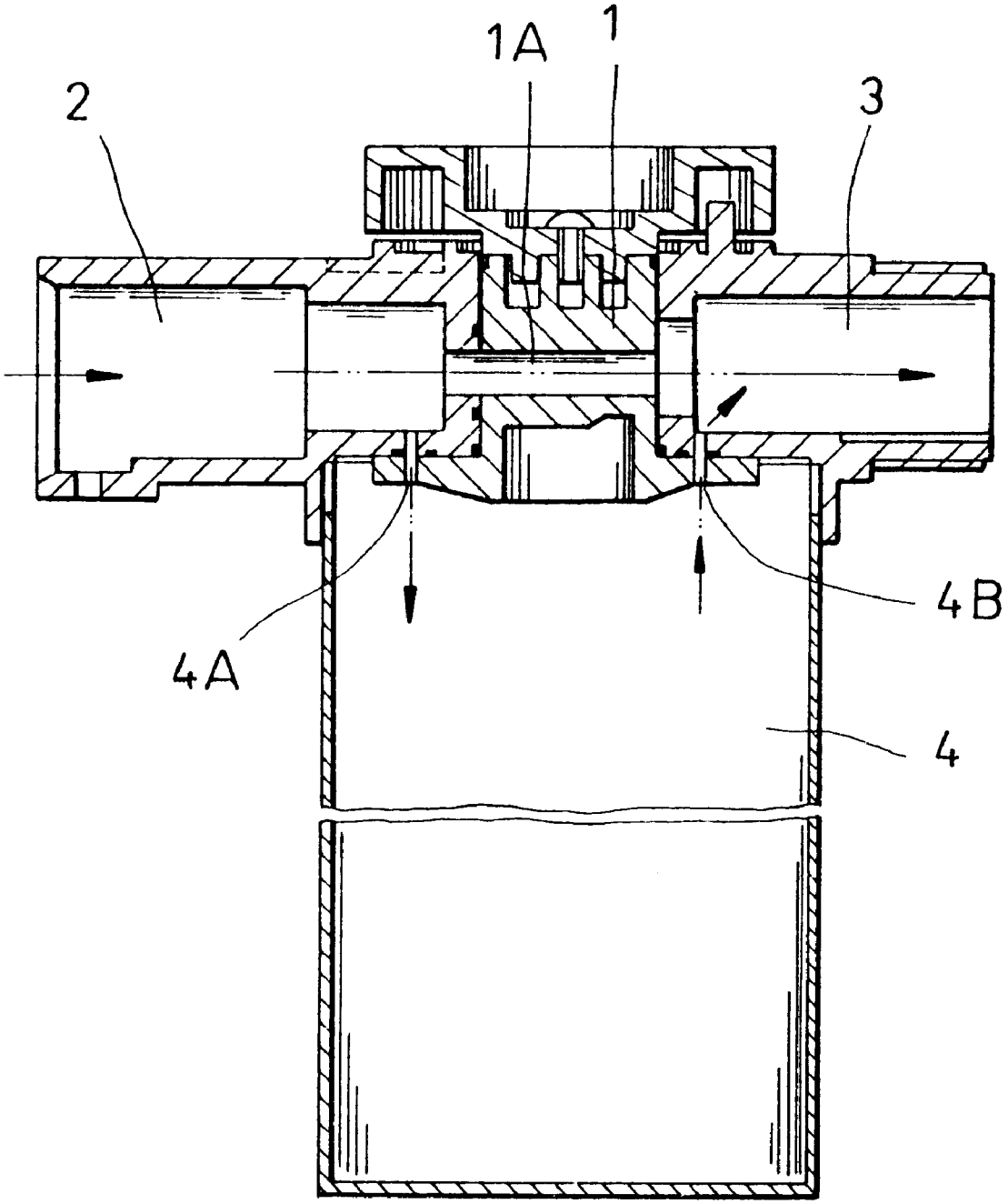
FIG. 1 PRIOR ART
FIG. 1 is a sectional view of a detergent/water mixing system of a water spray gun according to the prior art.
Figure 2:
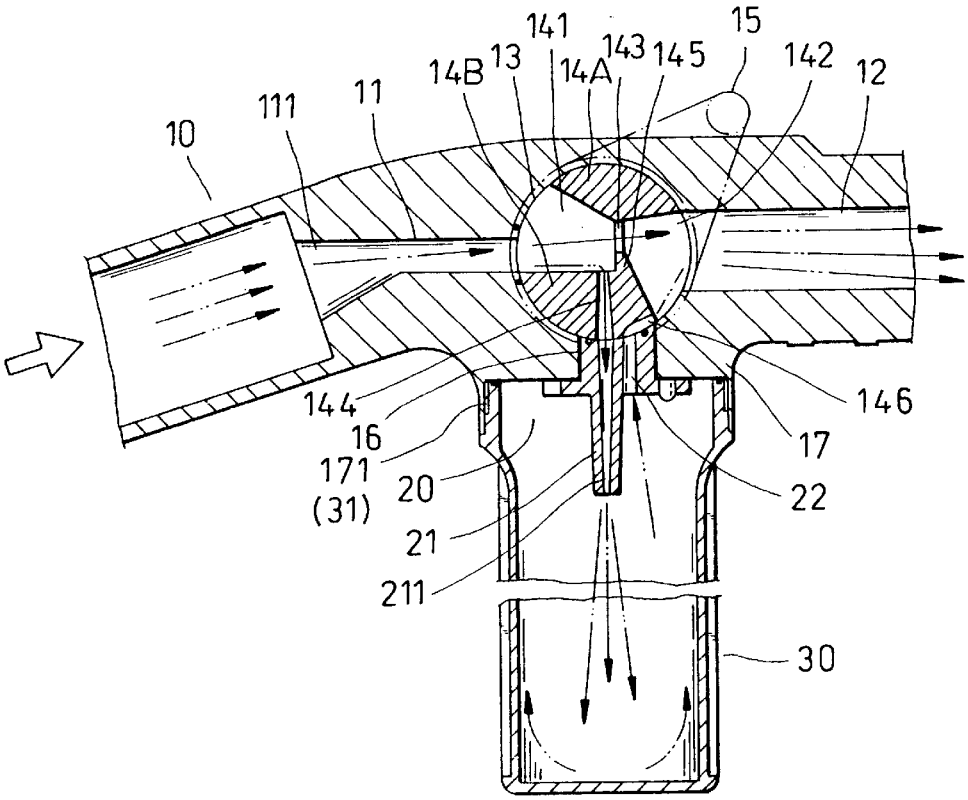
FIG. 2 is a sectional view of the present invention, showing the handle turned to the front side position.
Figure 3:
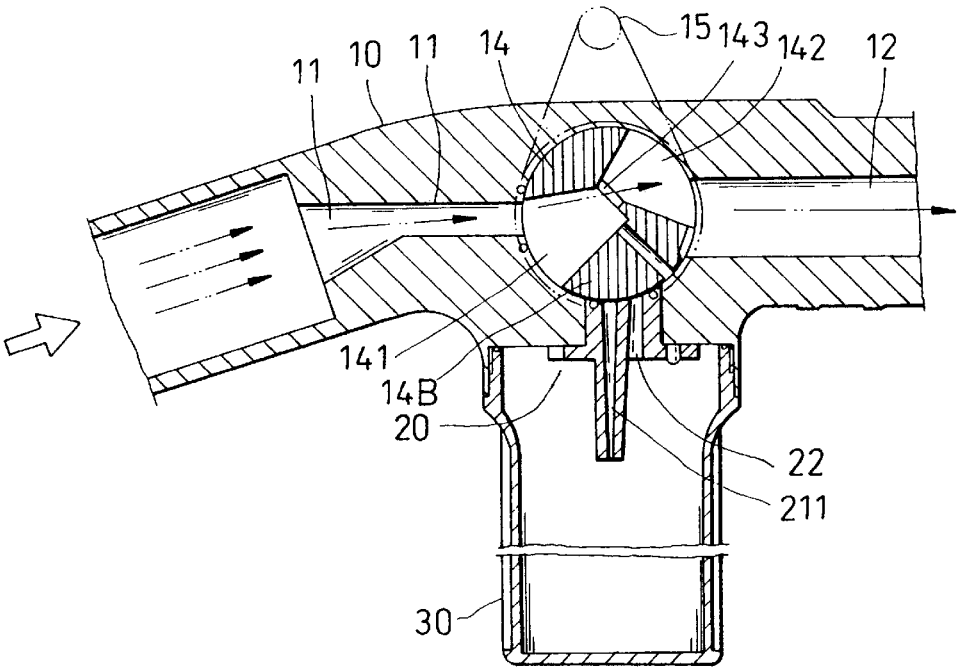
FIG. 3 is another sectional view of the present invention, showing the handle turned to the middle position.
Figure 4:
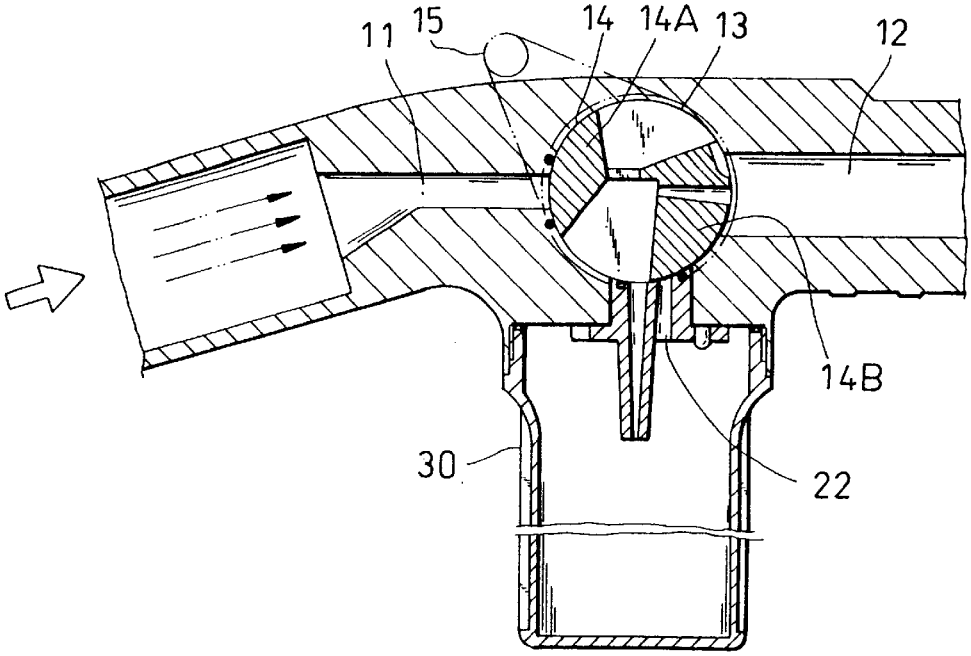
FIG. 4 is still another sectional view of the present invention, showing the handle turned to the rear side position.

Referring to FIGS. 2, 3 and 4, a detergent/water mixing system of a water spray gun in accordance with the present invention is generally comprised of a gun body 10, a jet ejector 20, and a detergent container 30.

The gun body 10 comprises a water inlet 11, a water outlet 12, a transversely horizontally extended cylindrical through hole 13 communicating between the water inlet 11 and the water outlet 12, a cylindrical control valve 14 mounted in the cylindrical through hole 13, a handle 15 connected to two opposite ends of the cylindrical control valve 14 and disposed on the outside for turning by hand to rotate the cylindrical control valve 14 in the cylindrical through hole 13. The water inlet 11 has an outer end terminating in a tapered orifice 111, which has a diameter gradually increasing toward the outside. The cylindrical control valve 14 comprises a first water chamber 141, a second water chamber 142, a narrow gap 143 communicating between the first water chamber 141 and the second water chamber 142, a first stop block 14A and a second stop block 14B separated by the water chambers 141;142 and the narrow gap 143, a guide hole 144 perpendicularly extended from the connecting area between the first water chamber 141 and the narrow gap 143 through the second stop block 14B to the outside, a guide wall 145 connected between the first stop block 14A and the second stop block 14B adjacent to the guide hole 144, and a guide groove 146 provided at the periphery of the second stop block 14B in communication with the second water chamber 142. The gun body 10 further comprises a cylindrical coupling portion 17 at the bottom side thereof, an inner thread 171 in the cylindrical coupling portion 17, and an axle hole 16 extended from the cylindrical through hole 13 through the center of the cylindrical coupling portion 17. Further, water seal rings or like means are provided at the connecting area between the water inlet 11 and the cylindrical through hole 13 as well as the connecting area between the axle hole 16 and the cylindrical through hole 13. The water chambers 141;142 each have a width gradually increasing from the narrow gap 143 toward the outside.

The jet ejector 20 is injection-molded from plastics and mounted in the axle hole 15 on the gun body 10, comprising a nozzle jet 21 corresponding to the guide hole 144 on the control valve 14, and a guide hole 22 in parallel to the nozzle jet 21. The nozzle jet 21 defines a tapered nozzle hole 211 having a diameter gradually reducing from the top end (the end which is connected to the gun body 10) toward the bottom end (the end remote from the gun body 10.

The detergent container 30 is a cylindrical container holding a detergent, having an outer thread 31 around the periphery of the top open end thereof. The outer thread 31 of the detergent container 30 is threaded into the inner thread 171 in the coupling portion 17 of the gun body 10.

When the handle 15 is turned to the front side position as shown in FIG. 2, the first water chamber 141 and the second water chamber 142 of the control valve 14 are respectively set into communication with the water inlet 11 and the water outlet 12, and the guide hole 144 is set into communication with the nozzle hole 211 of the nozzle jet 21. Therefore, water which passes through the tapered orifice 111 into the water inlet 11 and the first water chamber 141 is separated by the guide wall 145 into two flows, enabling one flow of water to rush into the guide hole 144, and the other flow of water to pass through the narrow gap 143 into the second water chamber 142. The flow of water which rushes into the guide hole 144 is ejected out of the nozzle hole 211 of the nozzle jet 21 into the detergent container 30, causing the detergent in the detergent container 30 to be mixed with water. When water is continuously ejected into the detergent container 30, well mixed detergent solution is forced to flow upwards through the guide hole 22 on the jet ejector 20 into the second water chamber 142 via the guide groove 146 on the control valve 14, and then carried out of the gun body 10 by the continuous flow of water which passes from the second water chamber 142 out of the gun body 10 through the water outlet 12.

When the handle 15 is turned to the middle position as shown in FIG. 3, the nozzle hole 211 and guide hole 22 of the jet ejector 20 are stopped by the second stop block 14B of the control valve 14, and water is allowed to pass from the water inlet 11 through the first water chamber 141, the narrow gap 143, and the second water chamber 142, and then into the water outlet 12.

When the handle 15 is turned to the rear side position as shown in FIG. 4, the water inlet 11 is stopped by the first stop block 14A of the control valve 14, therefore no water is allowed to pass from the water inlet 11 to the water outlet 12 through the control valve 14.

Figure 5:
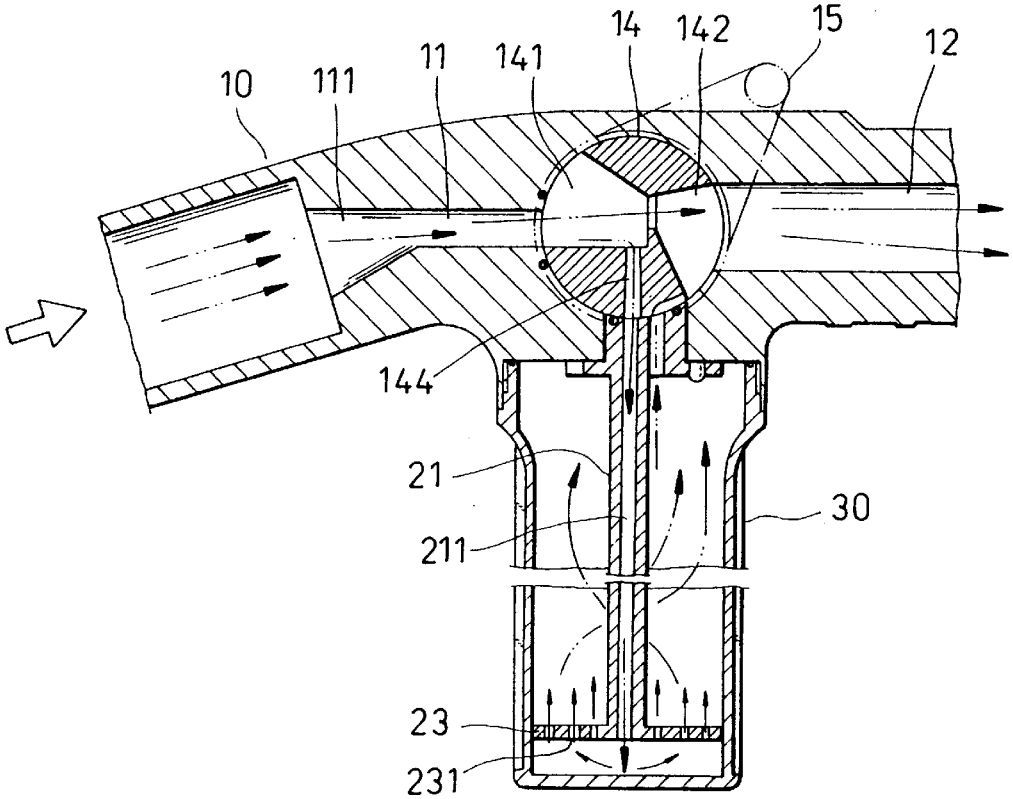
FIG. 5 is a sectional view of an alternate form of the present invention.

FIG. 5 shows an alternate form of the jet ejector 10. According to this alternate form, an outward flange 23 is raised around the periphery of the bottom end of the nozzle jet 21, and disposed close to and suspended above the bottom wall of the detergent container 30. The outward flange 23 fits closely inside the inner diameter of the detergent container 30, having a plurality of tiny through holes 231. When a jet of water is ejected out of the nozzle hole 211 of the nozzle jet 21, detergent solution is forced by water pressure to flow upwardly through the tiny through holes 231 on the outward flange 23 of the nozzle jet 21.

What the invention claimed is:

1. A detergent/water mixing system for a water spray gun comprising:

a gun body, said gun body comprising a water inlet, a water outlet, a transversely horizontally extended cylindrical through hole communicating between said water inlet and said water outlet, a cylindrical coupling portion raised from a bottom side wall thereof, and an axle hole perpendicularly extended from said cylindrical through hole through the center of said cylindrical coupling portion;

a cylindrical control valve mounted in said transversely horizontally extended cylindrical through hole, said cylindrical control valve comprising a first water chamber, a second water chamber, a narrow gap communicating between said first water chamber and said second water chamber, a first stop block and a second stop block separated by said first and second water chambers and said narrow gap, a guide hole perpendicularly extended from the connecting area between said first water chamber and said narrow gap through said second stop block to the outside of said control valve, a guide wall connected between said first stop block and said second stop block adjacent to the guide hole of said control valve, and a guide groove provided at said second stop block on the outside in communication with said second water chamber;

a handle connected to two opposite ends of said cylindrical control valve outside said gun body for turning by hand to rotate said cylindrical control valve in said transversely horizontally extended cylindrical through hole of said gun body;

a detergent container holding a detergent and detachably fastened to the coupling portion of said gun body by a screw joint; and a jet ejector mounted in said axle hole on said gun body and suspended in said detergent container, said jet ejector comprising a nozzle jet for guiding water from the guide hole on said control valve into said detergent container, and a guide hole for guiding detergent solution from said detergent container to the second water chamber of said control valve through the guide groove on said control valve;

wherein said control valve is turned in said transversely horizontally extended cylindrical through hole on said gun body by hand through said handle between a front side position where said first water chamber and said second water chamber of said control valve are respectively set into communication with said water inlet and said water outlet, and the guide hole and guide grooves of said control valve are set into communication with the nozzle jet and guide hole of said jet ejector, a middle position where the nozzle jet and guide hole of said jet ejector are stopped by the second stop block of said control valve and water is allowed to pass from said water inlet through said first water chamber, said narrow gap, and said second water chamber into said water outlet, and a rear side position where said water inlet is stopped by said first stop block of said control valve and no water is allowed to pass from said water inlet to said water outlet through said control valve.

2. The detergent/water mixing system of claim 1 wherein said nozzle jet defines a tapered nozzle hole having a diameter gradually reducing from one end which is coupled to said gun body to an opposite end remote from said gun body.

3. The detergent/water mixing system of claim 1 wherein said first water chamber and said second water chamber of said control valve each have a width gradually increasing from the center of said control valve to the outside of said control valve.

4. The detergent/water mixing system of claim 1 wherein said jet ejector comprises an outward flange raised around one end of said nozzle jet remote from said gun body and fitting closely inside said detergent container, said outward flange having a plurality of through holes.

* * * * *